US009822546B1

(12) United States Patent
Durham

(10) Patent No.: US 9,822,546 B1
(45) Date of Patent: Nov. 21, 2017

(54) REUSABLE GROUND ANCHOR, RELATED METHODS OF MANUAFACTURE AND METHODS OF USE

(71) Applicant: Daniel Durham, Fremont, MI (US)

(72) Inventor: Daniel Durham, Fremont, MI (US)

( * ) Notice: Subject to any disclaimer, the term of this patent is extended or adjusted under 35 U.S.C. 154(b) by 0 days.

(21) Appl. No.: 15/217,010

(22) Filed: Jul. 22, 2016

(51) Int. Cl.
*E04H 15/62* (2006.01)
*E04H 12/22* (2006.01)

(52) U.S. Cl.
CPC ..... *E04H 15/62* (2013.01); *E04H 12/223* (2013.01)

(58) Field of Classification Search
CPC ..... E04H 15/62; E04H 12/223
USPC ..... 135/118; 52/155
See application file for complete search history.

(56) References Cited

U.S. PATENT DOCUMENTS 362,183 A * 5/1887 Runyon ..... E02D 5/803 114/305
697,031 A * 4/1902 Snook ..... E02D 5/803 256/52
707,683 A * 8/1902 Farwell ..... E02D 5/803 114/305
727,335 A * 5/1903 Fisher ..... E02D 5/803 114/305
1,008,323 A * 11/1911 Gillespie ..... E02D 5/803 135/118
1,189,787 A * 7/1916 Caddy ..... E02D 5/803 135/118
1,805,084 A * 5/1931 Gianini ..... E04H 15/62 119/786
1,940,430 A * 12/1933 Morterra ..... E04H 12/223 244/115
5,217,194 A * 6/1993 Brownell ..... A63G 9/00 135/118
6,758,456 B2 * 7/2004 Krieger ..... E04H 15/62 248/156

FOREIGN PATENT DOCUMENTS

DE 2002329 A1 * 7/1971 ..... E02D 5/803
FR 357342 A * 12/1905 ..... E04H 15/62
FR 1027588 A * 5/1953 ..... E04H 12/223
GB 191419397 A * 0/1915 ..... E04H 15/62
GB 468207 A * 6/1937 ..... E04H 15/62
GB 554063 A * 6/1943 ..... E04H 15/62

* cited by examiner

*Primary Examiner* — David R Dunn
*Assistant Examiner* — Danielle Jackson
(74) *Attorney, Agent, or Firm* — James E. Shultz, Jr.

(57) ABSTRACT

Ground anchors are provided that may include at least one extendable protrusion. A ground anchor may include an extendable protrusion actuator configured to extend at least one extendable protrusion subsequent to a sub-surface portion of the ground anchor being inserted into the ground. A ground anchor may include a plurality of extendable protrusions configured to be extended by a single extendable protrusion actuator.

18 Claims, 7 Drawing Sheets

500a
500b
531b
530b
5B
5B 500c
532c
531c
530c 521a
522a
523a
535a
520a
524a
540a
545a
526a 500d
575d
576d
5E
5E
577d
500e 576e
575e 500g
533g
555g
534g
552g
556g 500f
5G
550f
551f
5G 500h
5H
560h
561h
5H 500j
563j
564j
565j
562j
566j

REUSABLE GROUND ANCHOR, RELATED METHODS OF MANUAFACTURE AND METHODS OF USE

TECHNICAL FIELD

The present disclosure generally relates to reusable ground anchors, methods of manufacture and methods of use. More particularly, the present disclosure relates to reusable ground anchors having extendable retention features.

BACKGROUND

Ground anchors are used in a wide variety of applications, for example, tent stakes, utility pole guy-wire anchors, vertical drill rig anchors, logging drag line rig anchors, etc. Some known ground anchors are intended to be reusable. Other known ground anchors are intended to remain in the ground once installed. Some known ground anchors require a related installation apparatus (e.g., a drill, a hammer, an insertion device, etc.).

In circumstances where known ground anchors are installed in loose soil (e.g., sandy soil, wet soil, gravel, etc.), associated anchor pull-out is problematic. Accordingly, ground anchors are desired having increased in-ground retention.

SUMMARY

A ground anchor may include an outer casing including at least one extendable retention feature engagement. The ground anchor may also include at least one extendable retention feature. The ground anchor may further include an extendable retention feature actuator reorientably inserted within the outer casing. When the extendable retention feature actuator is reoriented from a first orientation to a second orientation, the at least one extendable retention feature may engage the at least one extendable retention feature engagement and may be oriented in an extended orientation. When the extendable retention feature actuator is reoriented from the second orientation to the first orientation, the at least one extendable retention feature may disengage the at least one extendable retention feature engagement and may be reoriented in a retracted orientation.

In another embodiment, a ground anchor may include an outer casing. The ground anchor may also include at least one extendable retention feature. The ground anchor may further include an extendable retention feature actuator reorientably inserted within the outer casing. When the extendable retention feature actuator is reoriented from a first orientation to a second orientation, the at least one extendable retention feature may be oriented in an extended orientation. When the extendable retention feature actuator is reoriented from the second orientation to the first orientation, the at least one extendable retention feature may be reoriented in a retracted orientation.

In a further embodiment, a method of manufacturing a ground anchor having extendable retention features may include providing a ground anchor outer casing having at least one extendable retention feature engagement. The method may also include providing an extendable retention feature actuator having at least one extendable retention feature. The method may further include inserting the extendable retention feature actuator, having at least one extendable retention feature, into the ground anchor outer casing having at least one retention feature engagement such that the at least one extendable retention feature is beyond the at least one retention feature engagement. The method may yet further include bending the at least one extendable retention feature engagement to engage the extendable retention feature actuator.

These and other features, advantages and objects of the invention will be further understood and appreciated by reference to the following specification, claims and appended drawings.

DETAIL DESCRIPTION

Ground anchors having extendable retention features are provided. The extendable retention features may be reorientable between a retracted position and an extended position, as well as, reorientable between the extended position and the retracted position. Thus, the ground anchors may be reusable. Moreover, when the extendable retention features are retracted, a portion of the ground anchor that includes the extendable retention features may be inserted in the ground. Subsequent to inserting the portion of the ground anchor that includes the extendable retention features in the ground, the extendable retention features may be extended. With the extendable retention features extended, an associated pull-out force associated with a ground anchor having extendable retention features is greater than a ground anchor that does not include extendable retention features.

Methods of manufacturing ground anchors having extendable retention features are also provided. Methods of installing and/or removing ground anchors having extendable retention features are also provided.

Figure 1A:
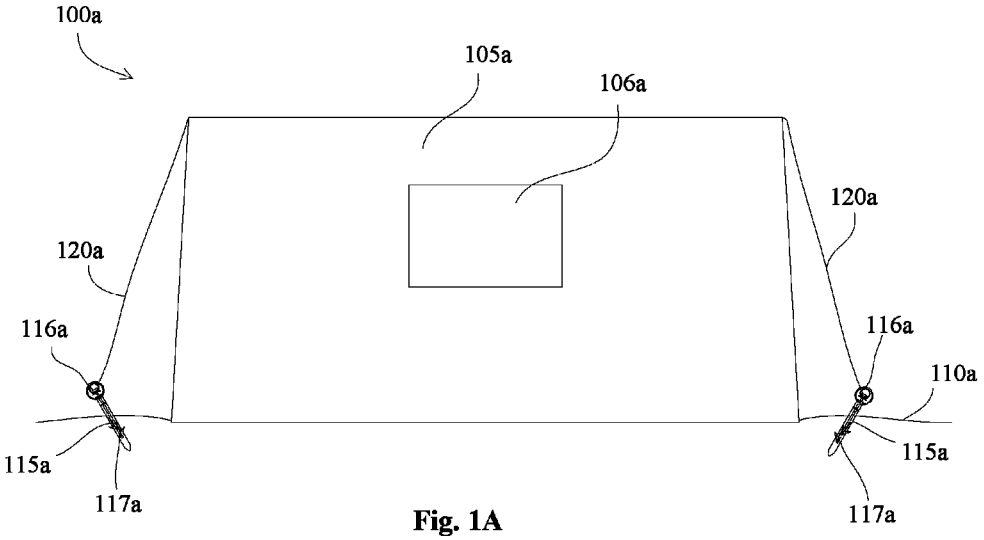
FIG. 1A depicts a profile view of a tent incorporating two example ground anchors having extendable retention features.

Turning to FIG. 1A, an assembly 100*a* may include a tent 105*a* incorporating two ground anchors having extendable retention features 115*a* that secure a respective guy wire 120*a* via a ground anchor connecting ring 116*a*. Each ground anchor 115*a* may include a portion secured in the ground 110*a* via respective extendable retention features 117*a*. The tent 105*a* may include a window (or vent) 106*a*. While the assembly 100*a* may include only two ground anchors having extendable retention features 115*a*, any given assembly 100*a* may include any number of ground anchors having extendable retention features 115*a* depending on, for example, a configuration of the tent 105*a*. In particular, an assembly 100*a* may include three, four, five, six, or more ground anchors having extendable retention features 115*a*. In any event, details of ground anchors having extendable retention features 115*a* are described herein.

Figure 1B:
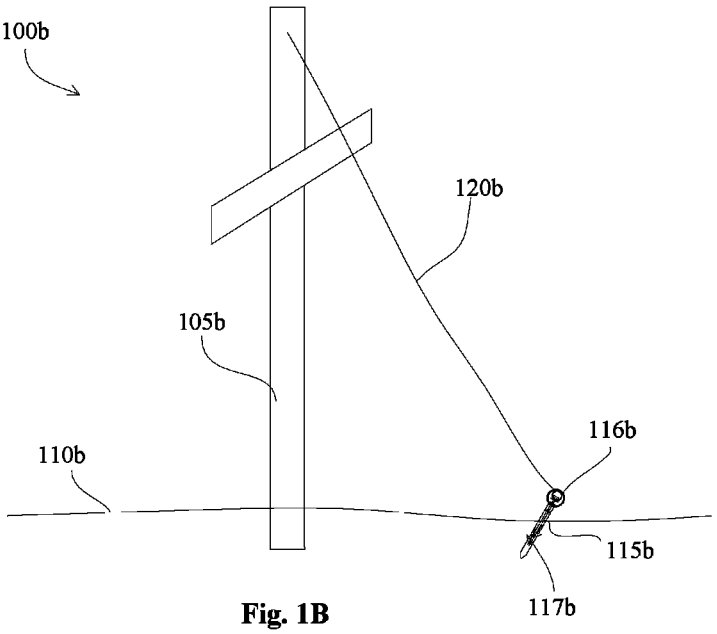
FIG. 1B, depicts a utility pole with a guy-wire secured to an example ground anchor having extendable retention features.

With reference to FIG. 1B, an assembly 100*b* may include a utility pole 105*b* with a guy-wire 120*b* secured to a ground anchor connecting ring 116*b* of a ground anchor having extendable retention features 115*b*. The ground anchor having extendable retention features 115*b* may be similar to, for example, the ground anchor having extendable retention features 115*a* of FIG. 1A. The ground anchor having extendable retention features 115*b* may include a portion secured in the ground 110*b* via respective extendable retention features 117*b*. While the assembly 100*b* may include only one ground anchor having extendable retention features 115*b*, any given assembly 100*b* may include any number of ground anchors having extendable retention features 115*b* depending on, for example, a configuration of the utility pole 105*b*. In particular, an assembly 100*b* may include two, three, four, five, six, or more ground anchors having extendable retention features 115*b*. In any event, details of ground anchors having extendable retention features 115*b* are described herein.

Figure 2A:
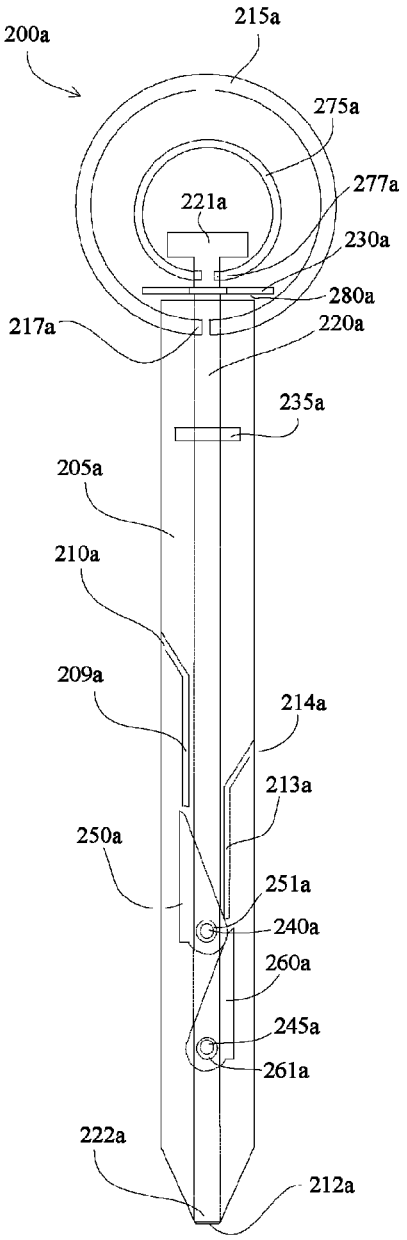
FIG. 2A depicts a profile view of an example ground anchor having extendable retention features in a retracted orientation.

Turning to FIG. 2A, a ground anchor having extendable retention features 200*a* is illustrated with the extendable retention features 250*a*, 260*a* in a retracted orientation. The ground anchor having extendable retention features 200*a* may be similar to, for example, the ground anchor having extendable retention features 115*a* of FIG. 1A or the ground anchor having extendable retention features 115*b* of FIG. 1B. The ground anchor having extendable retention features 200*a* may include an extendable retention feature actuator 220*a* slidably positioned within an outer casing 205*a* and an extendable retention feature actuator movement limiting ring 230*a*. The outer casing 205*a* of the ground anchor having extendable retention features 200*a* may include a first extendable retention feature engagement 209*a* connected to the outer casing 205*a* via a first offset 210*a*, a second extendable retention feature engagement 213*a* connected to the outer casing 205*a* via a second offset 214*a*, a pointed enclosed tip 212*a*, and a ground anchor outer casing connection ring 215*a* pivotally attached to the outer casing 205*a* via, for example, outer casing receptacles 217*a*.

The extendable retention feature actuator 220*a* may include an anchor head 221*a*, a distal end 222*a*, an extendable retention feature actuator movement limiter pin 235*a*, and a ground anchor extendable retention feature actuator connecting ring 275*a* pivotally secured to the extendable retention feature actuator 220*a* via, for example, extendable retention feature actuator receptacles 277*a*. The extendable retention feature actuator 220*a* may include a first extendable retention feature 250*a* pivotally attached to the extendable retention feature actuator 220*a* via first pivot pin 240*a* extending through, for example, a first extendable retention feature receptacle 251*a*. The extendable retention feature actuator 220*a* may include a second extendable retention feature 260*a* pivotally attached to the extendable retention feature actuator 220*a* via second pivot pin 245*a* extending through, for example, a second extendable retention feature receptacle 261*a*. While the extendable retention feature actuator 220*a* is illustrated in FIG. 2A to include two extendable retention features 250*a*, 260*a*, the extendable retention feature actuator 220*a* may include any number of extendable retention features. For example, an extendable retention feature actuator 220*a* may include three, four or more extendable retention features. Correspondingly, the ground anchor outer casing 205*a* may have a number of extendable retention feature engagements that matches a number of extendable retention features of an extendable retention feature actuator 220*a*.

Figure 2B:
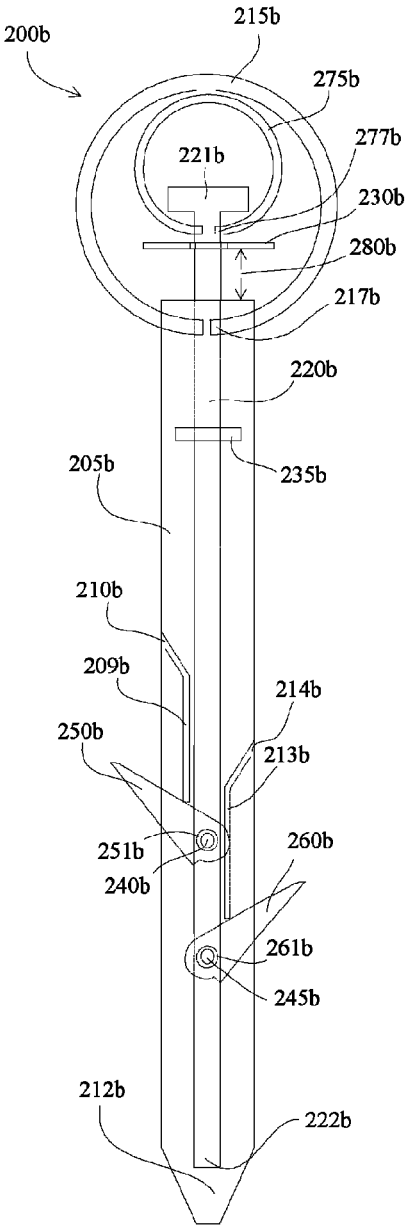
FIG. 2B depicts a profile view of an example ground anchor having extendable retention features in an extended orientation.

With reference to FIG. 2B, a ground anchor having extendable retention features 200*b* is illustrated with the extendable retention features 250*b*, 260*b* in an extended orientation. The ground anchor having extendable retention features 200*b* may be similar to, for example, the ground anchor having extendable retention features 200*a* of FIG. 2A. The ground anchor having extendable retention features 200*b* may include an extendable retention feature actuator 220*b* slidably positioned within an outer casing 205*b* and an extendable retention feature actuator movement limiting ring 230*b*. The outer casing 205*b* of the ground anchor having extendable retention features 200*b* may include a first extendable retention feature engagement 209*b* connected to the outer casing 205*b* via a first offset 210*b*, a second extendable retention feature engagement 213*b* connected to the outer casing 205*b* via a second offset 214*b*, a pointed enclosed tip 212*b*, and a ground anchor outer casing connection ring 215*b* pivotally attached to the outer casing 205*b* via, for example, outer casing receptacles 217*b*.

The extendable retention feature actuator 220*b* may include an anchor head 221*b*, a distal end 222*b*, an extendable retention feature actuator movement limiter pin 235*b*, and a ground anchor extendable retention feature actuator connecting ring 275*b* pivotally secured to the extendable retention feature actuator 220*b* via, for example, extendable retention feature actuator receptacles 277*b*. The extendable retention feature actuator 220*b* may include a first extendable retention feature 250*b* pivotally attached to the extendable retention feature actuator 220*b* via first pivot pin 240*b* extending through, for example, a first extendable retention feature receptacle 251*b*. The extendable retention feature actuator 220*b* may include a second extendable retention feature 260*b* pivotally attached to the extendable retention feature actuator 220*b* via second pivot pin 245*b* extending through, for example, a second extendable retention feature receptacle 261*b*. While the extendable retention feature actuator 220*b* is illustrated in FIG. 2B to include two extendable retention features 250*b*, 260*b*, the extendable retention feature actuator 220*b* may include any number of extendable retention features. For example, an extendable retention feature actuator 220*b* may include three, four or more extendable retention features. Correspondingly, the ground anchor outer casing 205*b* may have a number of extendable retention feature engagements that matches a number of extendable retention features of an extendable retention feature actuator 220*b*.

In any event, a portion of a ground anchor 200*a* may be inserted into the ground as, for example, illustrated in FIGS. 1A and 1B, with associated extendable retention features 250*a*, 260*a* in a retracted orientation as illustrated in FIG. 2A. For example, an individual may use a hammer to pound on the head 221*a*, thereby, encouraging the distal end 222*a* of the extendable retention feature actuator 220*a* to force the ground anchor outer casing 205*a* into the ground via contact at the pointed enclosed tip 212*a*. Subsequent to inserting the portion of the ground anchor 200*a*, 200*b* into the ground, the extendable retention feature actuator 220*a* may be repositioned from location 280*a* to the location of extendable retention feature actuator 220*b* at location 280*b*. Thereby, the extendable retention features 250*b*, 260*b* engage the extendable retention feature engagements 209*b*, 213*b* and are reoriented to an extended position as illustrated in FIG. 2B. When the extendable retention feature actuator 220*a* is repositioned from location 280*a* to the location of extendable retention feature actuator 220*b* at location 280*b*, the distal end 222*b* of the extendable retention feature actuator 220*b* may move away from the ground anchor outer casing 205*b* pointed enclosed tip 212*b*.

The ground anchor 200*b* may be removed from the ground by first moving the extendable retention feature actuator 220*b* from the position 280*b* to the position 280*a*. Thereby, the extendable retention features 250*b*, 260*b* are reoriented to a retracted position as illustrated in FIG. 2A. Subsequently, the ground anchor 200*a* may be pulled from the ground by, for example, grasping the outer casing connecting ring 215*a* and pulling the ground anchor 200*a* from the ground.

While the extendable retention feature actuator 220*a*, 220*b* is illustrated in FIGS. 2A and 2B, respectively, as being slidably positioned within the outer casing 205*a*, 205*b*, the extendable retention feature actuator 220*a*, 220*b* may alternatively be rotatably position positioned within the outer casing 205*a*, 205*b*. Corresponding, rotation of the extendable retention feature actuator 220*a*, 220*b* relative the outer casing 205*a*, 205*b* may cause the extendable retention features 250*a*, 260*a* to be extended 250*b*, 260*b* and/or may cause the extendable retention features 250*b*, 260*b* to be retracted 250*a*, 260*a*.

Alternatively, extendable retention features 250*a*, 260*a*, 250*b*, 260*b* may be attached directly to an outer casing 205*a*, 205*b* such that rotation of the outer casing 205*a*, itself, may cause the extendable retention features 250*a*, 260*a* to extend. In such a configuration, rotation of the outer casing 205*b* in an opposite direction may cause the extendable retention features 260*a* to retract. Accordingly, an extendable retention feature actuator 220*a*, 220*b* may be omitted.

Figure 3A:
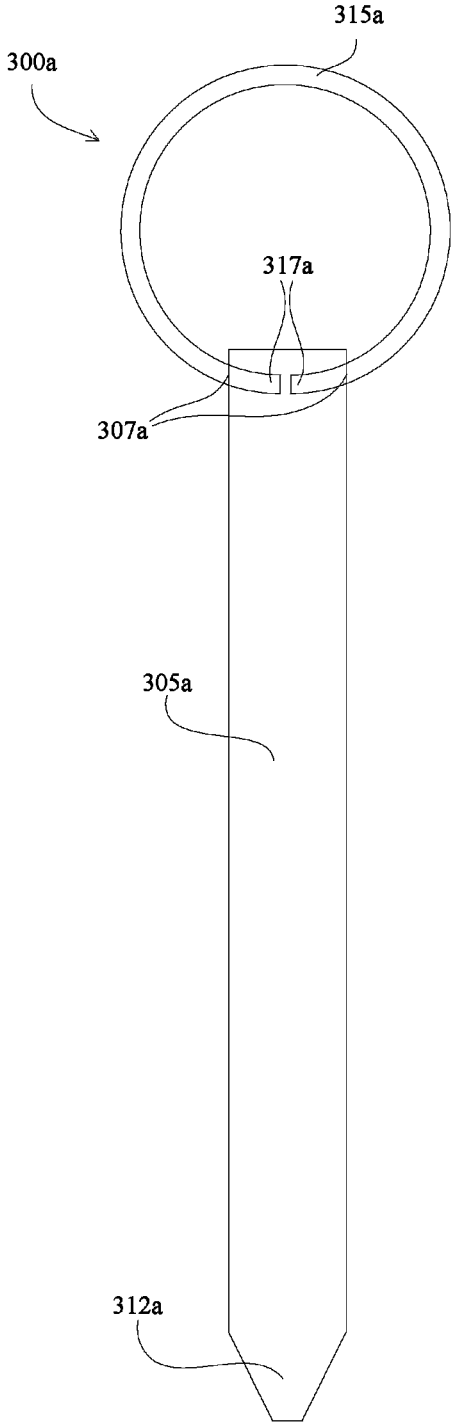
FIG. 3A depicts an example ground anchor outer casing.

Turning to FIG. 3A, a ground anchor assembly 300*a* may include a ground anchor outer casing 305*a*. The ground anchor outer casing 305*a* may be similar to, for example, the ground anchor outer casing 205*a* of FIG. 2A or the ground anchor outer casing 205*b* of FIG. 2B. The outer casing 305*a* may include extendable retention feature engagements connected to the outer casing (not illustrated in FIG. 3A), a pointed enclosed tip 312*a*, and a ground anchor outer casing connection ring 315*a* pivotally attached to the outer casing 305*a* via, for example, ground anchor outer casing connection ring ends 317*a* extending through respective outer casing receptacles 307*a*.

Figure 3B:
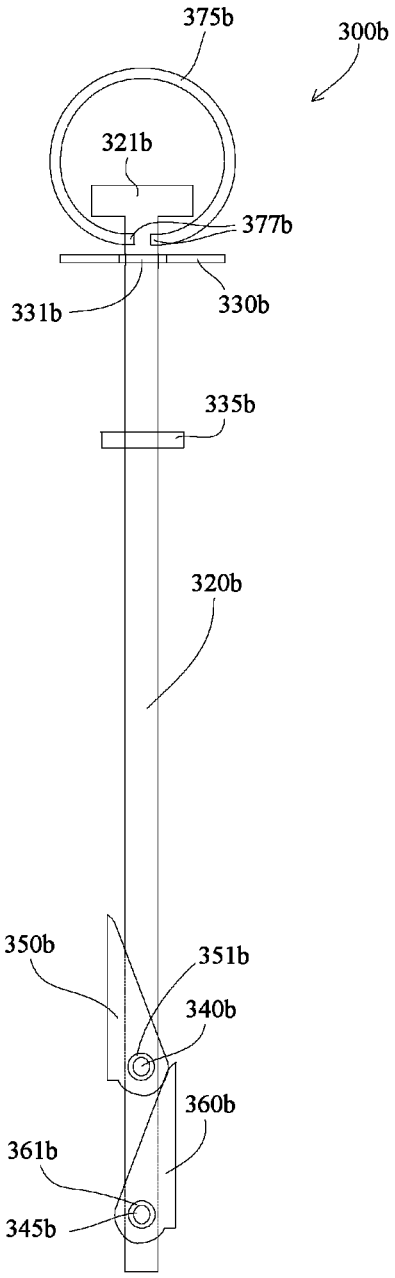
FIG. 3B depicts an example ground anchor extendable retention feature actuator.

With reference to FIG. 3B, a ground anchor assembly 300*b* may include a ground anchor extendable retention feature actuator 320*b*. The ground anchor extendable retention feature actuator 320*b* may be similar to, for example, the ground anchor extendable retention feature actuator 220*a* of FIG. 2A or the ground anchor extendable retention feature actuator 220*b* of FIG. 2B. The ground anchor extendable retention feature actuator 320*b* may include an anchor head 321*b*, an extendable retention feature actuator movement limiter pin 335*b*, and a ground anchor extendable retention feature actuator connecting ring 375*b* pivotally secured to the extendable retention feature actuator 320*b* via, for example, extendable retention feature actuator receptacles 377*b*. The extendable retention feature actuator 320*b* may include a first extendable retention feature 350*b* pivotally attached to the extendable retention feature actuator 320*b* via first pivot pin 340*b* extending through, for example, a first extendable retention feature receptacle 351*b*. The extendable retention feature actuator 320*b* may include a second extendable retention feature 360*b* pivotally attached to the extendable retention feature actuator 320*b* via second pivot pin 345*b* extending through, for example, a second extendable retention feature receptacle 361*b*. While the extendable retention feature actuator 320*b* is illustrated in FIG. 3B to include two extendable retention features 350*b*, 360*b*, the extendable retention feature actuator 320*b* may include any number of extendable retention features. For example, an extendable retention feature actuator 320*b* may include three, four or more extendable retention features. Correspondingly, the ground anchor outer casing 305*a* may have a number of extendable retention feature engagements that matches a number of extendable retention features of an extendable retention feature actuator 320*b*.

Figure 4B:
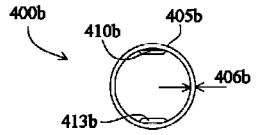
FIGS. 4A-4D depict details of an example ground anchor outer casing.
Figure 4C:
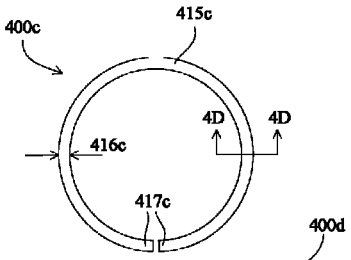
Figure 4D:
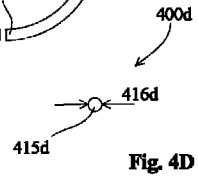
Figure 4A:
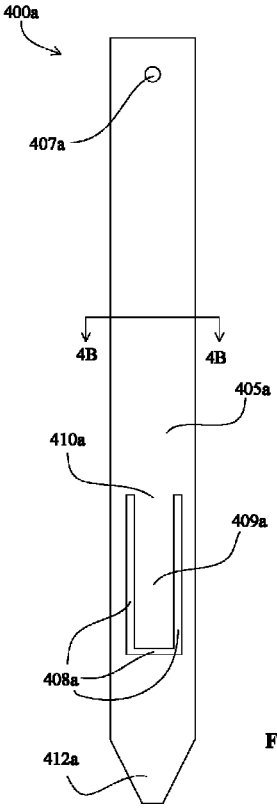

Turning to FIGS. 4A-4D, a ground anchor assembly 400*a*-400*d* may include a ground anchor outer casing 405*a*, 405*b*. The ground anchor outer casing 405*a*, 405*b* may be similar to, for example, the ground anchor outer casing 205*a* of FIG. 2A, the ground anchor outer casing 205*b* of FIG. 2B, or the ground anchor outer casing 305*a* of FIG. 3A. The outer casing 405*a* may include a first extendable retention feature engagement 410*a* connected to the outer casing 405*a* via a first offset 409*a*, a second extendable retention feature 413*b*, a pointed enclosed tip 412*a*, and a ground anchor outer casing connection ring 415*c*, 415*d* pivotally attached to the outer casing 405*a*, 405*b* via, for example, ground anchor outer casing connection ring ends 417*c* extending through respective outer casing receptacles 407*a*. The plan view of the ground anchor assembly 400*b*, as illustrated in FIG. 4B, is as taken along the section line 4B-4B of FIG. 4A. The plan view of the ground anchor outer casing connecting ring 415*d*, as illustrated in FIG. 4D, is as taken along the section line 4D-4D of FIG. 4C.

With reference to FIGS. 5A-5H and 5J, a ground anchor assembly 500*a*-500*h*, 500*j* may include a ground anchor extendable retention feature actuator 520*a*. The ground anchor extendable retention feature actuator 520*a* may be similar to, for example, the ground anchor extendable retention feature actuator 220*a* of FIG. 2A, the ground anchor extendable retention feature actuator 220*b* of FIG. 2B, or the ground anchor extendable retention feature actuator 320*b* of FIG. 3B. The ground anchor extendable retention feature actuator 520*a* may include an anchor head 521*a*, an extendable retention feature actuator movement limiter pin 535*a* to be inserted through an aperture 523*a*, and a ground anchor extendable retention feature actuator connecting ring 575*d*, 575*e* which may be pivotally secured to the extendable retention feature actuator 520*a* via, for example, extendable retention feature actuator receptacles 522*a*. The extendable retention feature actuator 520*a* may include a first extendable retention feature 550*f*, 550*g* which may be pivotally attached to the extendable retention feature actuator 520*a* via first pivot pin 540*a* extending through, for example, a first extendable retention feature receptacle 551*f*, 552*g* and aperture 524*a*. The extendable retention feature actuator 520*a* may include a second extendable retention feature 560*h*, 560*j* which may be pivotally attached to the extendable retention feature actuator 520*a* via second pivot pin 545*a* extending through, for example, a second extendable retention feature receptacle 561*h*, 562*h* and aperture 526*a*. While the extendable retention feature actuator 520*a* is illustrated in FIGS. 5A, 5F, 5H and 5J to include two extendable retention features 550*a*, 560*h*, the extendable retention feature actuator 520*a* may include any number of extendable retention features. For example, an extendable retention feature actuator 520*a* may include three, four or more extendable retention features.

Figures 5A, 5B, 5C, 5D, 5E, 5F, 5G, 5H, 5J:
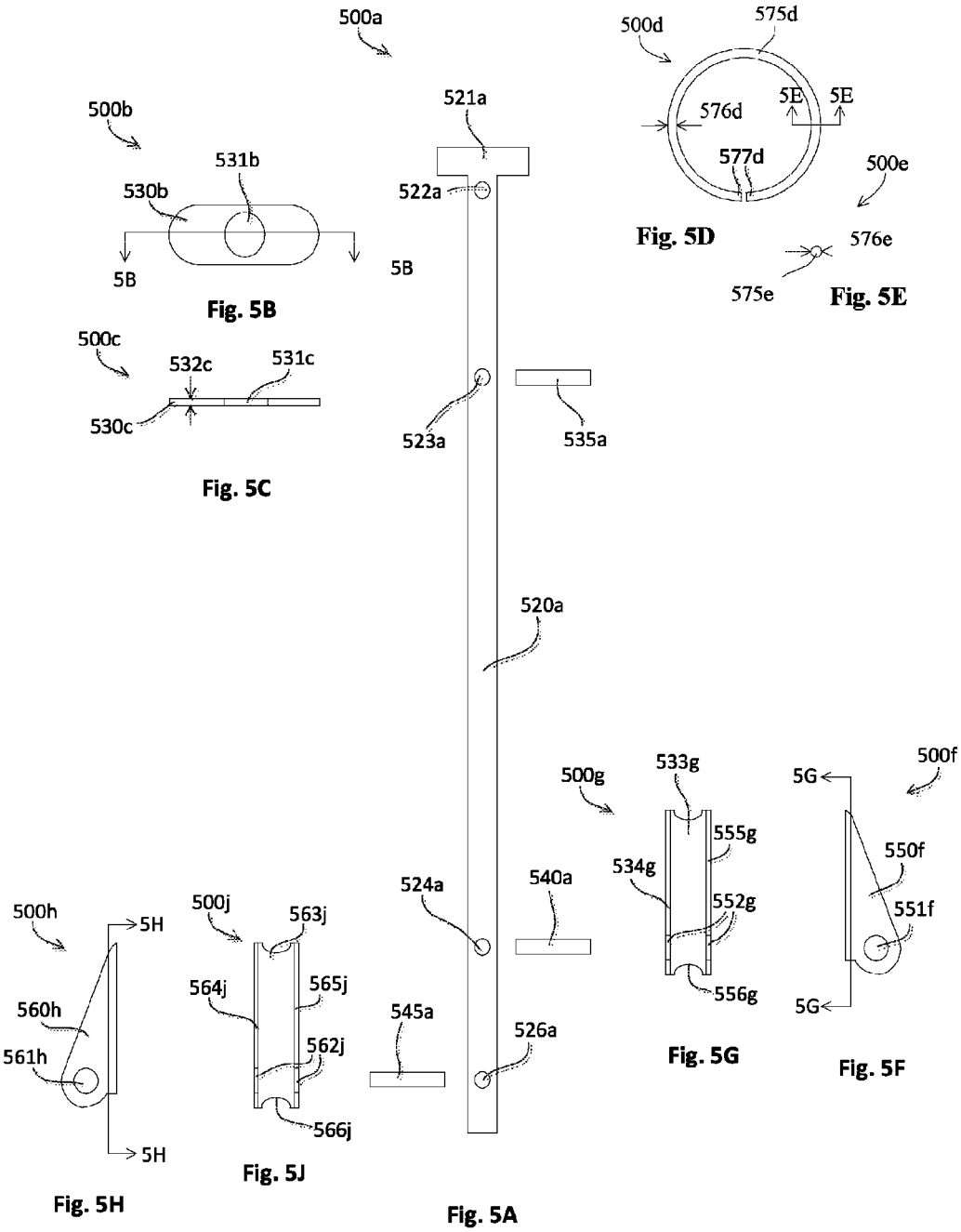
FIGS. 5A-5H and 5J depict details of an example ground anchor extendable retention feature actuator.

The first extendable retention feature 550*e* may include a first side 554*g* and a second side 555*g* extending perpendicular from a base 553*g* having a recess 556*g*. The plan view of the first extendable retention feature 550*e*, as illustrated in FIG. 5G, is as taken along the section line 5G-5G of FIG. 5F.

The second extendable retention feature 560*h* may include a first side 564*j* and a second side 565*j* extending perpendicular from a base 563*j* having a recess 566*j*. The plan view of the second extendable retention feature 560*h*, as illustrated in FIG. 5H, is as taken along the section line 5J-5J of FIG. 5J.

The ground anchor extendable feature actuator connecting ring 575*d*, 575*e* may include ring ends 477*d* for insertion into respective receptacles 522*a*. The ground anchor extendable feature actuator connecting ring 575*d*, 575*e* may include an outside dimension 576*d*, 576*e*. The profile view of the ground anchor extendable feature actuator connecting ring 575*d*, 575*e*, as illustrated in FIG. 5E, is as taken along the section line 5E-5E of FIG. 5D.

The ground anchor assembly 500*a*-500*h*, 500*j* may include a ground anchor extendable feature actuator movement limiting ring 530*b*, 530*c* having an aperture 531*b*, 531*c*, and a thickness 532*c*. The profile view of the ground anchor extendable feature actuator movement limiting ring 530*c*, as illustrated in FIG. 5C, is as taken along the section line 5C-5C of FIG. 5B.

Figure 6:
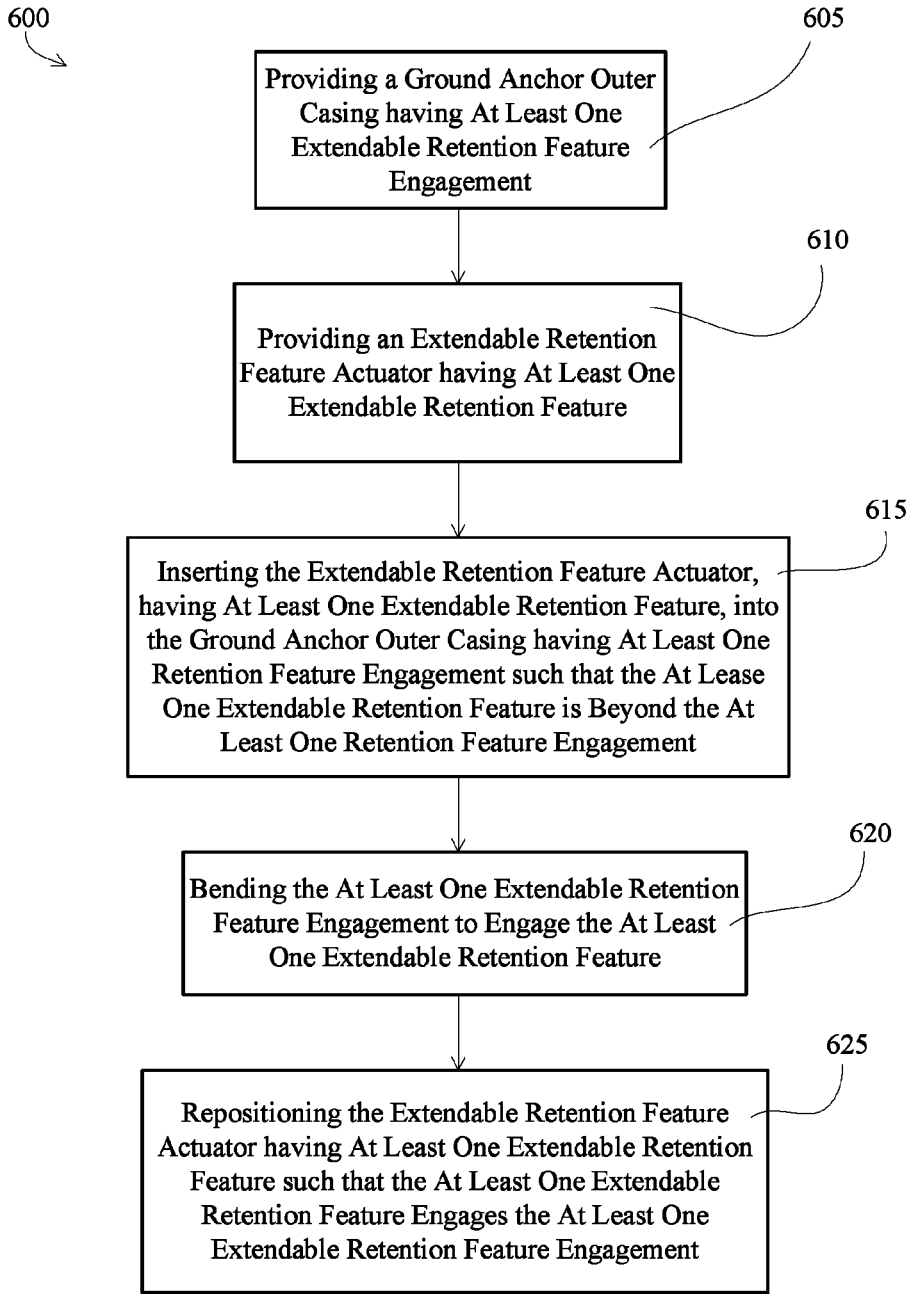
FIG. 6 depicts a flow diagram of an example method of manufacturing a ground anchor having extendable retention features.

Turning to FIG. 6, a method of manufacturing a ground anchor having extendable retention features 600 may include providing a ground anchor outer casing having at least one extendable retention feature engagement (block 605). For example, a ground anchor outer casing may be similar to, for example, the ground anchor outer casing 205*a* of FIG. 2A, the ground anchor outer casing 205*b* of FIG. 2B, the ground anchor outer casing 305*a* of FIG. 3A, the ground anchor outer casing 405*a* or FIG. 4A, or the ground anchor outer casing 405*b* of FIG. 4B.

The method 600 may also include providing an extendable retention feature actuator having at least one extendable retention feature (block 610). A ground anchor extendable retention feature actuator may be similar to, for example, the ground anchor extendable retention feature actuator 220*a* of FIG. 2A, the ground anchor extendable retention feature actuator 220*b* of FIG. 2B, the ground anchor extendable retention feature actuator 320*b* of FIG. 3B, or the ground anchor extendable retention feature actuator 520*a* of FIG. 5A.

The method 600 may further include inserting the extendable retention feature actuator, having at least one extendable retention feature, into the ground anchor outer casing having at least one retention feature engagement such that the at least one extendable retention feature is beyond the at least one retention feature engagement (block 615). The method 600 may yet further include bending the at least one extendable retention feature engagement to engage the at least one extendable retention feature (block 620). The method 600 may also include repositioning the extendable retention feature actuator having at least one extendable retention feature such that the at least one extendable retention feature engages the at least one extendable retention feature engagement (block 625). A ground anchor having extendable retention features, resulting from the method 600, may be similar to, for example, the ground anchor having extendable retention features 200*a* as described with regard to FIG. 2A.

Figure 7:
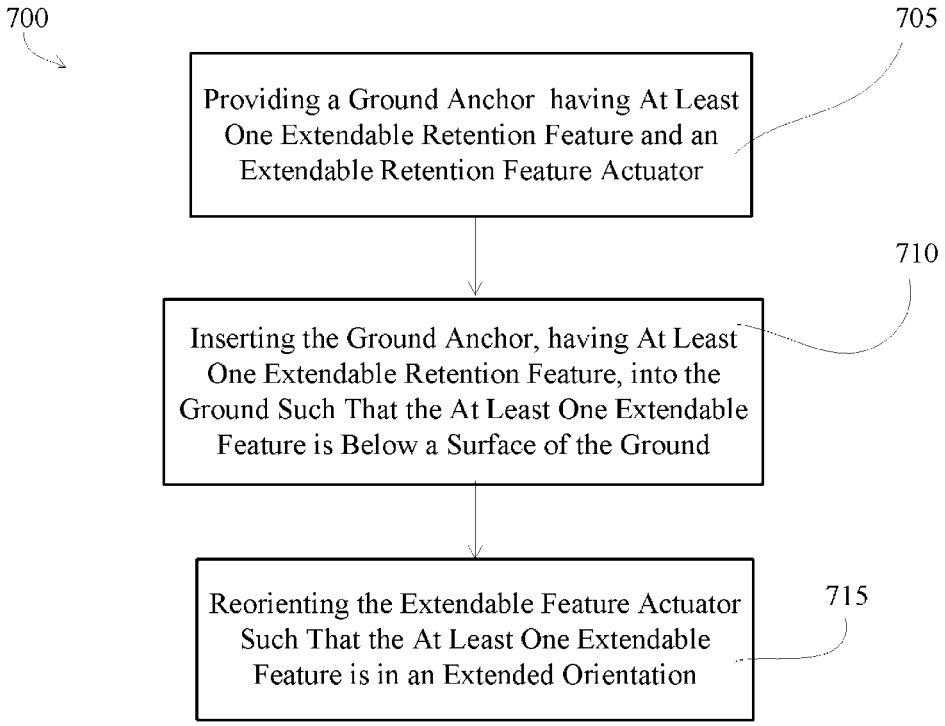
FIG. 7 depicts a flow diagram of an example method of installing a ground anchor having extendable retention features.

With reference to FIG. 7, a method of installing a ground anchor having extendable retention features 700 may include providing a ground anchor having at least one extendable retention feature and an extendable retention feature actuator (block 705). A ground anchor having extendable retention features may be similar to, for example, the ground anchor having extendable retention features 200*a* as described with regard to FIG. 2A.

The method 700 may also include inserting the ground anchor having at least one extendable retention feature into the ground such that the at least one extendable feature is below a surface of the ground (block 710) as illustrated in, for example, FIGS. 1A and 1B. The method 700 may further include reorienting the extendable feature actuator such that the at least one extendable feature is in an extended orientation (block 715) as illustrated in, for example, FIG. 2B.

The above description is considered that of exemplary embodiments. Modifications of the claimed invention will occur to those skilled in the art and to those who make or use the claimed invention. The embodiments shown in the drawings, and described above, are included for illustrative purposes and to satisfy written description requirements. The drawings and described embodiments are not intended to limit the scope of the claimed invention in any way. Indeed, the appending claims are to be interpreted according to the principles of patent law, including the doctrine of equivalents.

What is claimed is:

1. A ground anchor, comprising:

an outer casing including at least one extendable retention feature engagement, wherein the at least one extendable retention feature engagement includes an offset, and wherein the at least one extendable retention feature engagement and the offset extend into an interior of the outer casing;

at least one extendable retention feature; and an extendable retention feature actuator reorientably inserted within the outer casing, wherein, when the extendable retention feature actuator is at least partially withdrawn from the outer casing from a first orientation to a second orientation, the at least one extendable retention feature engages the at least one extendable retention feature engagement and is oriented in an extended orientation, and wherein, when the extendable retention feature actuator is reoriented from the second orientation to the first orientation, the at least one extendable retention feature disengages the at least one extendable retention feature engagement and is reoriented in a retracted orientation.

2. The ground anchor of claim 1, wherein the extendable retention feature actuator is linearly reorientable with respect to the outer casing.

3. The ground anchor of claim 1, wherein the extendable retention feature is rotatably reorientable with respect to the extendable retention feature actuator.

4. The ground anchor of claim 1, including at least two extendable retention features, wherein the outer casing includes at least two extendable retention feature engagements.

5. The ground anchor of claim 1, wherein the at least one extendable retention feature is pivotally attached to the extendable retention feature actuator.

6. The ground anchor of claim 1, wherein the extendable retention feature actuator includes an extendable retention feature actuator connecting ring pivotally attached to the extendable retention feature actuator.

7. The ground anchor of claim 1, wherein the outer casing includes an outer casing connecting ring pivotally attached to the outer casing.

8. A ground anchor, comprising:

an outer casing including at least one extendable retention feature engagement extending from at least one offset into an interior of the outer casing;

at least one extendable retention feature; and an extendable retention feature actuator reorientably inserted within the outer casing, wherein, when the extendable retention feature actuator is at least partially withdrawn from the outer casing from a first orientation to a second orientation, the at least one extendable retention feature engages the at least one extendable retention feature engagement and is oriented in an extended orientation, and wherein, when the extendable retention feature actuator is reoriented from the second orientation to the first orientation, the at least one extendable retention feature disengages the at least one extendable retention feature engagement and is reoriented in a retracted orientation.

9. The ground anchor of claim 8, wherein the extendable retention feature actuator is linearly reorientable with respect to the outer casing.

10. The ground anchor of claim 8, wherein the extendable retention feature is rotatably reorientable with respect to the extendable retention feature actuator.

11. The ground anchor of claim 8, wherein the at least one extendable retention feature is pivotally attached to the extendable retention feature actuator.

12. The ground anchor of claim 8, wherein the extendable retention feature actuator includes an extendable retention feature actuator connecting ring pivotally attached to the extendable retention feature actuator.

13. The ground anchor of claim 8, wherein the outer casing includes an outer casing connecting ring pivotally attached to the outer casing.

14. A method of manufacturing a ground anchor as in claim 8 having extendable retention features, the method comprising:

providing the ground anchor outer casing having the at least one extendable retention feature engagement;

providing the extendable retention feature actuator having the at least one extendable retention feature;

inserting the extendable retention feature actuator, having the at least one extendable retention feature, into the ground anchor outer casing having the at least one retention feature engagement such that the at least one extendable retention feature is beyond the at least one retention feature engagement; and bending the at least one extendable retention feature engagement to define an offset such that the at least one extendable retention feature engages the at least one extendable retention feature engagement when the extendable retention feature actuator is at least partially withdrawn from the ground anchor outer casing.

15. The method of claim 14, further comprising:

repositioning the extendable retention feature actuator having at least one extendable retention feature such that the at least one extendable retention feature engages the at least one extendable retention feature engagement.

16. The method of claim 14, wherein the extendable retention feature actuator is linearly reorientable with respect to the outer casing.

17. The method of claim 14, wherein the extendable retention feature is rotatably reorientable with respect to the extendable retention feature actuator.

18. The method of claim 14, wherein the at least one extendable retention feature is pivotally attached to the extendable retention feature actuator.

* * * * *